US005129694A

United States Patent [19]

Tanimoto et al.

[11] Patent Number: 5,129,694

[45] Date of Patent: Jul. 14, 1992

[54] LAMINATED INSIDE DOOR HANDLE ASSEMBLY AND METHOD

[75] Inventors: Tetsurou Tanimoto, Kariya; Morihito Nomura, Toyoake, both of Japan

[73] Assignee: Aisin Seiki Kabushiki Kaisha, Kariya, Japan

[21] Appl. No.: 674,735

[22] Filed: Mar. 26, 1991

[30] Foreign Application Priority Data

Mar. 27, 1990 [JP] Japan ..... 2-32381[U]

[51] Int. Cl.[5] ..... E05B 3/00

[52] U.S. Cl. ..... 292/347; 292/DIG. 38; 292/DIG. 31; 292/DIG. 8; 29/437

[58] Field of Search ..... 292/347, DIG. 8, DIG. 19, 292/DIG. 31, DIG. 38; 29/437

[56] References Cited

U.S. PATENT DOCUMENTS

| | | | |
|---|---|---|---|
| D. 112,807 | 1/1939 | Cossin | 292/DIG. 8 |
| 2,125,783 | 8/1938 | Heeman | 292/DIG. 8 X |
| 2,348,065 | 5/1944 | George | 292/DIG. 31 X |
| 2,425,611 | 8/1947 | Frost et al. | 292/347 |
| 2,722,445 | 11/1955 | Cudney | 292/DIG. 31 X |
| 3,655,230 | 4/1972 | Armstrong | 292/DIG. 31 X |
| 4,858,973 | 8/1989 | Ogasawara et al. | 292/DIG. 31 X |
| 5,011,204 | 4/1991 | Labrum | 292/347 |

*Primary Examiner*—Richard E. Moore

*Attorney, Agent, or Firm*—Finnegan, Henderson, Farabow, Garrett and Dunner

[57] ABSTRACT

An inside door handle assembly is comprised of a bezel secured to a door of a vehicle and a handle pivotally mounted on the bezel for opening the door. The bezel and/or door has a main portion of a hard rigid material and an outer surface portion of a resilient material.

11 Claims, 1 Drawing Sheet

LAMINATED INSIDE DOOR HANDLE ASSEMBLY AND METHOD

TECHNICAL FIELD

The present invention relates to an inside door handle assembly, and more particularly, to the construction of the bezel and handle of an inside vehicle door handle assembly.

DESCRIPTION OF RELATED ART

Conventionally, an inside door handle assembly includes a bezel secured to a door of a vehicle and a handle pivotally mounted on the bezel for opening the door. Typically, the bezel of the inside door handle is made of single common material, and the door handle is made of single common material which typically is the same material as the bezel. Thus, the bezel and/or handle does not permit desired visual or tactile variation.

SUMMARY OF THE INVENTION

It is, therefore, a principal object of the present invention to provide an inside door handle assembly which permits material having different visual characterization, such as color to be employed in the construction of the bezel and/or handle.

Another object of the present invention is to provide an inside door handle assembly for a vehicle where the handle and/or bezel are made of materials having different tactile characteristics.

Additional objects and advantages of the present invention will be set forth in part in the description which follows, and in part will be obvious from the description or may be learned by practice of the invention. The objects and advantages of the invention may be realized and attained by means of the instrumentalities and combinations particularly pointed out in the appended claims.

In order to attain the objects, and in accordance with the purpose of the invention, as embodied and broadly described herein, the inside door handle assembly comprises a bezel secured to a door of a vehicle, and a handle pivotally mounted on the bezel for opening the door, the handle having a main portion of hard material and a resilient surface portion attached to the main portion.

In another aspect, the inside door handle assembly of the present invention comprises a bezel having a main portion of hard material and an outer resilient surface portion fixed to the main portion.

In still another aspect, the invention relates to a method of forming the handle and bezel of the inside door handle assembly comprising injection molding a hard material corresponding to at least one of the bezel and handle to form a main portion, and injection molding a soft material onto the hard material for forming an outer surface portion of the at least one handle and bezel of the assembly.

In yet another aspect, the invention relates to a method of forming at least one of the handle and bezel portion of an inside door handle assembly comprising constructing a main portion of hard material having a first surface, constructing an outer portion of resilient material having a second surface and means fixing integrals the second surface of the outer surface portion to the first surface of the main portion for forming the respective handle and bezel.

The accompanying drawings which are incorporated in and constitute a part of this specification, illustrate one embodiment of the invention and together with the description serve to explain the principles of the invention.

BRIEF DESCRIPTION OF PREFERRED EMBODIMENTS

Reference will now be made in detail to the present preferred embodiment of the invention, an example of which is illustrated in the accompanying drawings.

Figure 1:
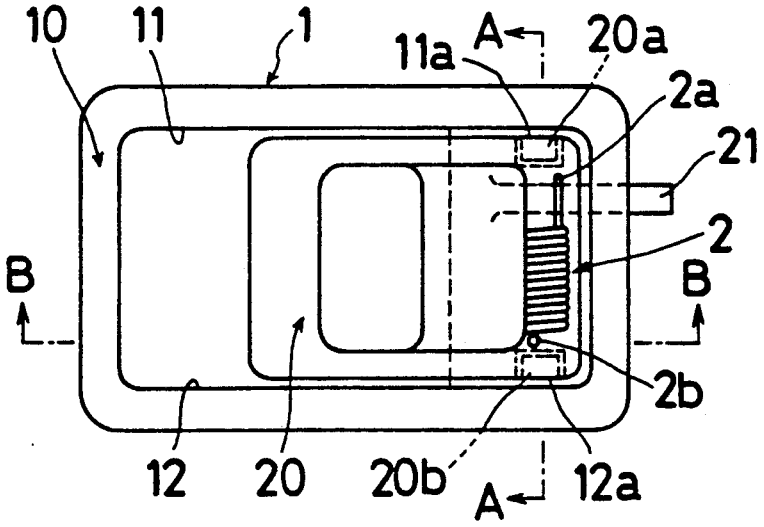
FIG. 1 is a plan view of an inside door handle assembly according to one embodiment of the present invention.
Figure 2:
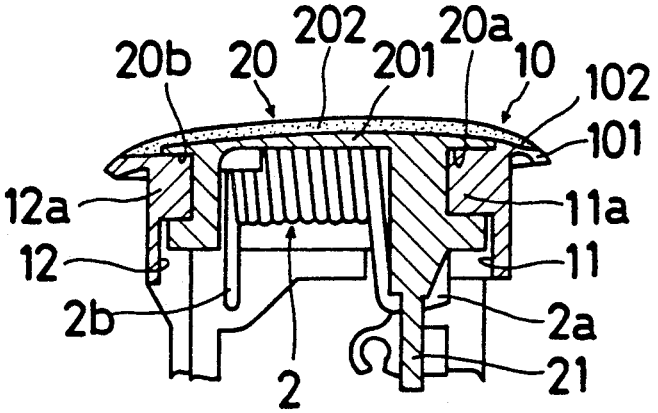
FIG. 2 is a cross sectional view taken along line A—A in FIG. 1.
Figure 3:
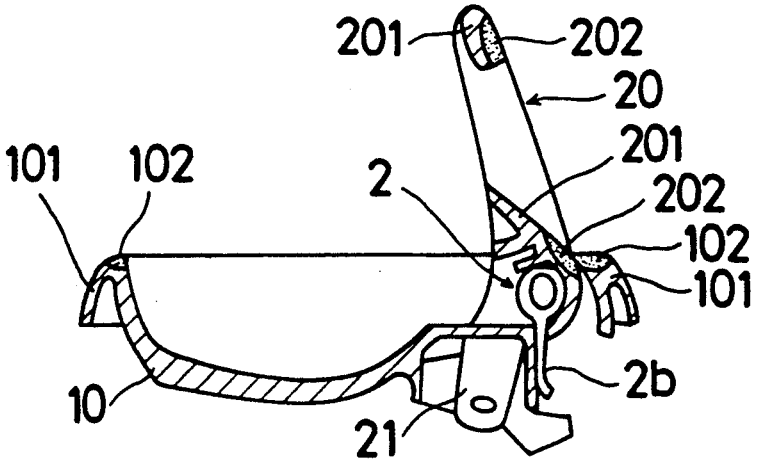
FIG. 3 is a cross sectional view taken along line B—B in FIG. 1.

Referring now to FIGS. 1 through 3, an inside door handle assembly 1 includes a bezel 10 which is secured to a vehicle door (not shown) and a handle 20 which is rotatably mounted to the bezel 10 via a spring 2. The bezel 10 has opposing longitudinal side walls 11 and 12 formed integrally with cylindrical projections 11*a* and 12*a* respectively. Handle 20 has outwardly facing grooves 20*a* and 20*b* into which the respective cylindrical projections 11*a* and 12*a* of the bezel 10 rotatably fit. Thus, the handle 20 can be rotated relative to the bezel 10. An arm portion 21 is formed integrally with the handle 20 adjacent the groove 20*a*. A rod (not shown) is connected to the arm portion 21. The spring 2 is mounted on the handle 20 in such a manner that one end portion 2*a* and the other end portion 2*b* of the spring 2 is retained by a projection (not shown) of the arm portion 21 in the bezel 10. Due to the spring 2, the vehicle door handle is continuously urged to the closed condition.

A main portion 101 of the bezel 10 is made from a hard resin material such as conventional polycarbonate resin, 6-nylon resin, polyacetal resin or similar resin having hard and rigid characteristics.

However, bezel 10 has an outer surface portion 102 of which serves as a covering for all or part of an outside surface of the main portion 101, which opposes and corresponds generally to the contour of the hand of occupant while opening the door. The covering or outer surface portion 102 is made from a soft resilient material such as soft thermoplastic elastomer (TPE), TPE of urethane family, TPE of styrene family, TPE of olefin family, TPE of ester family, TPE of amid family, ionomeer, vulcanized rubber (CR) or soft polyvinyl chloride.

A main portion 201 of handle 20 is made from the hard resin material similar to main portion 101 of the bezel 10 as above described. Also, outer surface portion 202 of handle 20 is made from a soft material of the type described in connection with outer surface portion 102 of bezel 10.

Though the aforementioned inside door handle may be constructed by any conventional method, one preferable method for forming the handle from the previously mentioned hard and soft material is accomplished by injection molding. More specifically, the bezel and/or the handle of the inside door handle assembly have two laminated layers, a hard layer main portion and a soft resilient layer outer surface. The composite two-layer laminated handle and/or bezel is constructed by first injection molding the hard material into a suitable mold, and then forming the outer surface portion by injecting the soft material onto a portion of the hard material which corresponds to the selected outer surface portion.

Instead of the foregoing injection molding method, another preferable method comprises constructing each of the layers of the the bezel and/or handle of the inside door handle assembly separately in two layers or parts, namely a hard material main layer and a resilient outer surface layer. Each of the layers has a surface that corresponds to a similar surface of one another. One surface of the soft, deformable resilient material portion is then fastened by cementing, for example, to the complementing surface of the hard material portion to form the bezel and/or handle of the inside door handle assembly.

As mentioned above, in the present invention, the flexibility in design of the inside door handle assembly can be increased due to the fact that it is formed by two materials having different visual and tactile characteristics. This has remarkable merit in light of the user's various demands with respect to the color of the vehicle interior. In addition, in the event of a collision of the vehicle the occupant may strike the inside door handle. In such a situation, the soft or resilient material acts as a cushion so as to minimize injury to the occupant.

Although a certain specific embodiment of the present invention has been shown and described, it will be apparent to those skilled in the art that various modifications and variations can be made in the inside door handle assembly and method of the present invention. Thus, it is intended that the present invention cover the modification and variations provided they come within the scope of the appended claims and their equivalents.

What we claim is:

1. An inside door handle assembly comprising:

a bezel for securing to a door of a vehicle, said bezel having a recessed main portion bounded by a perimeter portion;

a handle having a main portion pivotally mounted in the recessed portion of the bezel, said handle being urged to one position and operable to another position for opening the door;

soft resilient material disposed on the perimeter portion of the bezel and the main portion of the handle forming a first outer deformable surface bounding the recessed main portion of the bezel and a second deformable outer surface portion of the main portion of the handle co-planar with and opposing the first deformable outer surface at times when the handle is in the one position.

2. The inside door handle assembly of claim 1 wherein the first outer deformable surface surrounds the recessed main portion of the bezel.

3. The inside door handle assembly of claim 2 wherein the second outer deformable surface opposes the surrounding deformable first surface.

4. The inside door handle assembly of claim 1 wherein the main portion of the handle is made of hard material.

5. The inside door handle assembly of claim 1 wherein the recessed main and perimeter portion of the bezel is made of a hard material.

6. The inside door handle assembly of claim 4 wherein the material of the main portion is selected from any one of the group consisting of polycarbonate resin, 6-nylon resin, and polyacetal resin.

7. The inside door handle assembly of claim 5 wherein the material of the recessed main and perimeter portion of the bezel is selected from any one of the group consisting of polycarbonate resin, 6-nylon resin, and polyacetal resin.

8. The inside door handle assembly of claim 4 wherein the material of the first outer surface portion is selected from any one of the group consisting of soft thermoplastic elastomer (TPE), TPE of urethane family, TPE of ester family, TPE of amid family, ionomeer, vulcanized rubber (CR), and soft polyvinyl chloride.

9. The inside door handle assembly of claim 5 wherein the material of the second outer surface portion is selected from any one of the group consisting of soft thermoplastic elastomer (TPE), TPE of urethane family, TPE of styrene family , TPE of olefin family, TPE of ester family, TPE of amid family, ionomeer, vulcanized rubber (CR), and soft polyvinyl chloride.

10. A method of constructing of an inside door assembly of a vehicle having a bezel with a recessed main portion and a perimeter portion, and having a handle with a main portion pivotally mounted in the recessed main portion wherein the handle is urged to one position and operable to another position for opening the door, the method comprising:

injection molding the bezel to form the recessed main portion and the perimeter portion;

injection molding the handle to form the main portion and to form a means on the handle for pivoting the handle in the bezel;

injection molding soft resilient material onto the perimeter portion forming a first outer deformable surface surrounding the recessed main portion of the bezel;

injection molding soft resilient material onto the main portion of the handle forming a second outer deformable surface to be substantially co-planar with the first deformable outer surface when mounted to the bezel; and assembling the handle in the recessed main portion of the bezel via the pivotal means positioning the outer first and second deformable surfaces in coplanar relationship with edges of the first and second deformable surfaces opposing each other when in the one position.

11. A method of constructing an inside door handle assembly of a vehicle, having a bezel with a recessed main portion and an outer perimeter portion, and having a handle with a main portion pivotally mounted in the recessed portion wherein the handle is urged to one position and operable to another position for opening the door, the method comprising:

forming a bezel having a recessed main portion and a perimeter portion with a first predetermined surface contour;

forming a handle with a main portion having a second predetermined surface contour;

forming a first outer portion having one surface with a complementing contour corresponding to the first predetermined surface contour, and an opposite planar surface;

forming a second outer portion having one surface with a complementing contour corresponding to the second predetermined surface contour and an opposite planar surface, said first and second outer portions being dimensioned to position the respective opposite planar surfaces substantially flush with one another; and fastening the respective complementing surface to the outer perimeter of the bezel and the main portion of the handle to oppose one another at respective edges at times when the handle is in one position.

* * * * *